US011319679B2

(12) United States Patent
Vanaman

(10) Patent No.: US 11,319,679 B2
(45) Date of Patent: May 3, 2022

(54) BRIDGE CONSTRUCTION SYSTEM AND METHOD

(71) Applicant: Andy Vanaman, Tulsa, OK (US)

(72) Inventor: Andy Vanaman, Tulsa, OK (US)

( * ) Notice: Subject to any disclaimer, the term of this patent is extended or adjusted under 35 U.S.C. 154(b) by 140 days.

(21) Appl. No.: 16/938,885

(22) Filed: Jul. 24, 2020

(65) Prior Publication Data

US 2021/0025120 A1 Jan. 28, 2021

Related U.S. Application Data

(60) Provisional application No. 62/878,236, filed on Jul. 24, 2019.

(51) Int. Cl.

| | |
|---|---|
| ***E01D 21/00*** | (2006.01) |
| ***E01D 19/12*** | (2006.01) |
| ***E01D 18/00*** | (2006.01) |
| ***E01D 2/00*** | (2006.01) |
| *E01D 101/26* | (2006.01) |
| *E01D 101/30* | (2006.01) |

(52) U.S. Cl.

CPC ..... *E01D 21/00* (2013.01); *E01D 2/00* (2013.01); *E01D 18/00* (2013.01); *E01D 19/125* (2013.01); *E01D 2101/26* (2013.01); *E01D 2101/30* (2013.01)

(58) Field of Classification Search

CPC ..... E01D 2/00; E01D 18/00; E01D 19/00; E01D 21/00; E01D 2101/26; E01D 2101/30

USPC ..... 14/73–78

See application file for complete search history.

(56) References Cited

U.S. PATENT DOCUMENTS

| | | | | |
|---|---|---|---|---|
| 3,906,571 | A * | 9/1975 | Zetlin | E01D 1/00 52/630 |
| 4,211,504 | A * | 7/1980 | Sivachenko | E02D 29/0283 405/150.1 |
| 5,771,518 | A * | 6/1998 | Roberts | E01D 19/02 14/73.1 |
| 8,870,890 | B2 * | 10/2014 | Aschmann | A61B 17/7065 606/99 |
| 9,856,614 | B1 * | 1/2018 | Jiang | E01D 19/02 |
| 9,970,166 | B2 * | 5/2018 | Aston | E01F 5/005 |

(Continued)

FOREIGN PATENT DOCUMENTS

| | | | | |
|---|---|---|---|---|
| GB | 2390102 | * | 6/2002 | E04B 5/26 |

*Primary Examiner* — Raymond W Addie

(74) *Attorney, Agent, or Firm* — Head, Johnson, Kachigian & Wilkinson, PC

(57) ABSTRACT

The bridge construction system and method according to the present invention provides a lightweight, efficient, economical, long-lasting, and easily implemented composite steel structure that can be filled with concrete in place for the construction of pedestrian and smaller road bridges, specifically those found in rural areas. The bridge construction system of the present invention is unique in that it is a steel-frame reinforced composite bridge with decking and rebar caging that provides a permanent, non-removable form for poured-in-place concrete. The composite nature of the bridge allows for installation of the bridge to take place in one day, while the entire process from site preparation such as grading and excavation to cleanup takes a week or less. The quick installation of the bridge is designed to have a minimally invasive impact on the surrounding environment.

10 Claims, 9 Drawing Sheets

(56) References Cited

U.S. PATENT DOCUMENTS

2007/0163058 A1* 7/2007 Homsi ..... E01D 21/06
14/77.1
2011/0016645 A1* 1/2011 Porter ..... E01D 22/00
405/232

* cited by examiner

BRIDGE CONSTRUCTION SYSTEM AND METHOD

BACKGROUND

The present invention relates to a bridge construction system and method in general and more particularly to a modular and composite bridge construction system and method for pedestrian and small road bridges, specifically in rural environments.

Traditionally, prior art bridges for which the present invention is meant to replace are found in rural areas or are smaller bridges typically around forty feet in length and under. Most of these exist on county roads in rural areas where the age of these bridges is typically reaching the end of their intended life cycle and the condition of the bridge is deteriorating. Depending on whether the bridge is a rated or non-rated bridge typically determines how these types of bridges are constructed. For a rated bridge, meaning that it is approved to hold a specific amount of weight, construction typically consists of cast-in-place or precast concrete structures, steel structures, or wood/timber structures. Those building materials are the typical materials used for such rural bridges. For non-rated bridges, the building materials may consist of the same materials, but also often consist of culverts or sometimes even more questionable materials such as old railroad cars with the ends cutoff. Culverts are typically constructed from a variety of materials including cast-in-place or precast concrete, steel, aluminum, or even plastic.

The construction of these types of bridges is often difficult, inefficient, expensive, and time-consuming. Construction of these bridges can often have a heavy environmental impact on the construction area. Due to the nature of the design, many of the prior art types of bridges contain debris catchments which provide areas for debris to get caught up when water is flowing through. This can lead to decreased flow volume for water to flow through the bridge or culvert, as well as the requirement for maintenance to clear up the debris. These prior art designs also typically provide areas of erosion and washout which can lead to failure of the bridge. Hydrodynamic or bridge scour is also an often an ever present issue that can cause bridge failure with these designs. Due to these issues, there are often high maintenance costs associated with these prior art bridges.

For the foregoing reasons, there is a need for new and unique bridge construction system and method that overcomes the inefficiencies and problems with the prior art bridges that is quick and easy to install, lightweight, long-lasting, and cost-effective.

SUMMARY

The present invention is directed to a bridge construction system and method that satisfies the foregoing needs. The bridge construction system and method according to the present invention provides a lightweight, efficient, economical, long-lasting, and easily implemented composite steel structure that can be filled with concrete in place for the construction of pedestrian and smaller road bridges, specifically those found in rural areas.

The bridge construction system of the present invention fills a need in rural areas for a lightweight, long-lasting, cost-effective composite steel structure that can be installed quickly and filled with concrete in place to create a bridge made to last for decades. The bridge construction system of the present invention is a composite steel structure that is unloaded, erected, and site filled with concrete to build a bridge that is capable of meeting certain design standards. The bridge construction system of the present invention is designed to meet American Association of State Highway Transportation Officials loading standards (AASHTO HL-93) or reduced design standards if the system is being used for a pedestrian bridge. The design of the present invention is a completely open flowway so that it does not include any debris catchments, which helps to significantly increase flow volume, as well as provide reduced long-term maintenance costs due to not having to deal with the snags and clogs associated with debris catchments. The design of the present invention also provides for significantly increased flow capacity over traditional prior art designs, specifically when compared to traditional round culverts. The design of the present invention also helps to decrease erosion and washout opportunities when compared to prior art designs due to its open flowway and scour edges that are addressed with concrete reinforced steel beams.

The bridge construction system of the present invention is unique in that it is a steel-frame reinforced composite bridge with decking and rebar caging that provides a permanent, non-removable form for poured-in-place concrete. The composite nature of the bridge allows for installation of the bridge to take place in one day, while the entire process from site preparation such as grading and excavation to cleanup takes a week or less. The quick installation of the bridge is designed to have a minimally invasive impact on the surrounding environment.

The bridge construction system of the present invention is comprised of at least eight precast concrete setting blocks that act as the foundation of the bridge, two steel abutment walls, four steel wing walls or flat head walls dependent on design, a plurality of lower steel beams including two steel scour beams, lower rebar mats and scour edge rebar cages, a plurality of upper steel tub girders, a plurality of upper decking panels, upper rebar mats, and any required fasteners to connect the various bridge components.

The steel abutment walls and wing walls or flat head walls dependent on design are designed to be hollow so that they can be infilled with concrete when concrete is poured to create the bridge. Therefore, the walls act as a form for the poured-in-place concrete. Further, all steel components that are exposed to earth and water are covered with a finish for corrosion resistance as well and environmental and wildlife concerns.

The method of constructing the bridge construction system of the present invention comprises the below listed steps.

The first step is preparing the site where the bridge construction system is to be installed, which comprises demolition of previous infrastructure, if applicable, excavation and bridge base preparation.

The second step of the present invention is to layout and install the precast concrete setting blocks or "wallpads" according to a specific design's specifications which act as the foundation of the bridge.

The third step comprises the installation/setting of the steel abutment walls and steel wing walls or flat head walls (dependent on design) and braces. The abutment walls and corresponding wing walls or flat head walls come to the site already connected together. The far abutment and wing wall is set on the precast setting blocks, braced and leveled and then the near abutment and wing wall is set on the precast setting blocks, braced and leveled.

The fourth step comprises the installation/setting of the plurality of lower steel beams and the two lower steel scour beams.

The fifth step comprises installation/setting of the lower rebar mats and the scour edge beams rebar cages.

The sixth step comprises the installation/setting of the plurality of upper steel tub girders.

The seventh step comprises the installation/setting of the plurality of upper decking panels.

The eighth step comprises the installation of the upper rebar mats.

The ninth step comprises the pouring of the concrete where necessary, including the infilling of the composite steel structure of the present invention.

The tenth step comprises cleaning up of the site.

Steps two through nine of the method for constructing the bridge construction system of the present invention has specifically been designed to be able to be finished in one day, while the entire process can be finished in a week or less.

While it is to be understood that both the foregoing general description and the following detailed description are exemplary and explanatory only and are not restrictive on the present invention, these and other features, aspects, and advantages of the present invention will become better understood with regard to the following detailed description and accompanying drawings where:

DESCRIPTION

Figure 1:
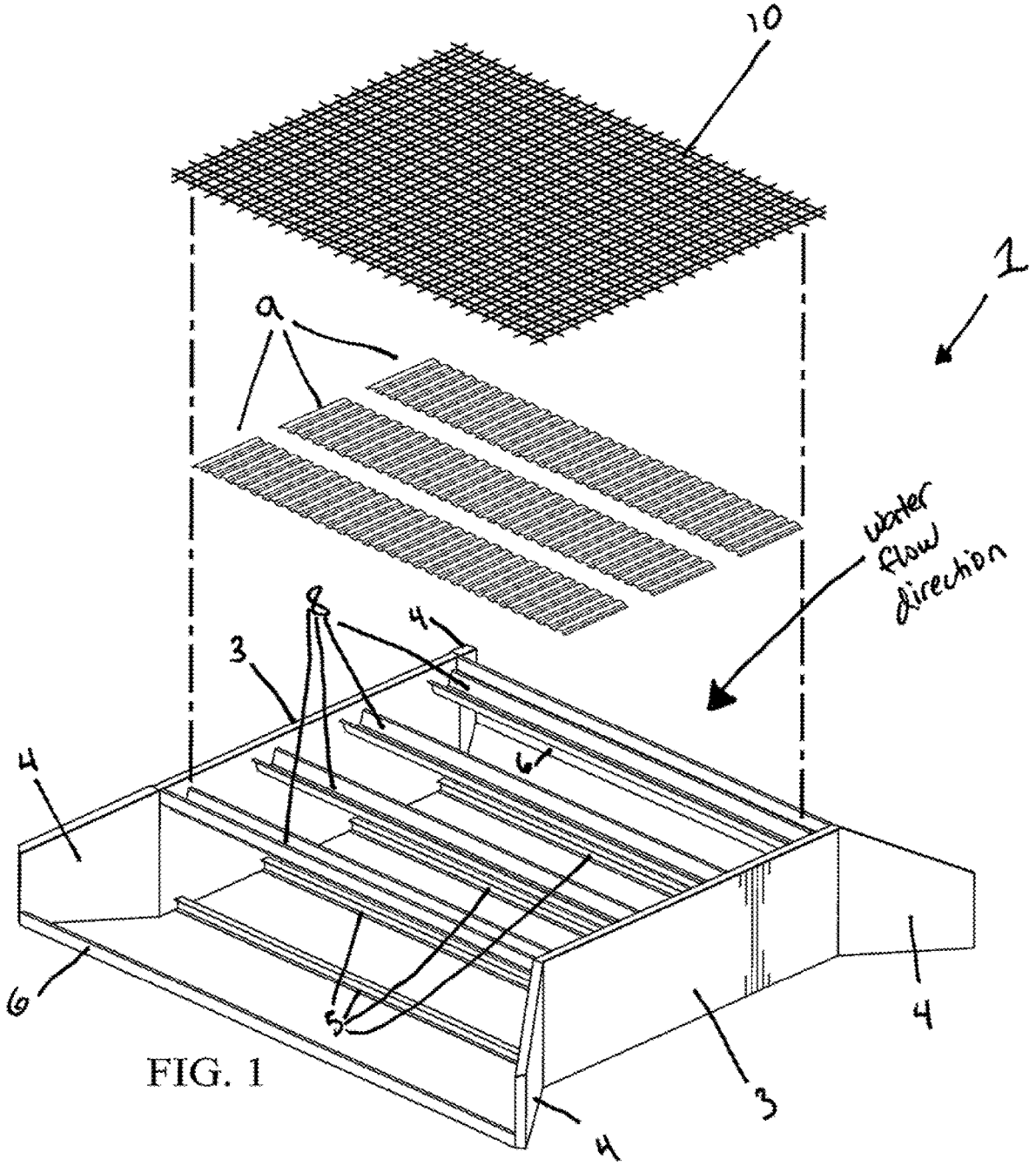
FIG. 1 is an exploded perspective view of a bridge construction system of the present invention showing some of the various components.

Referring now to the drawings, reference will be made to the preferred embodiment of the invention, an example of which is illustrated in the accompanying drawings and not meant for purposes of limiting the scope of the present invention. With reference to FIG. 1, it is generally shown a bridge construction system 1 of the present invention, depicting various components comprising said system. The bridge construction system of the present invention is comprised of at least eight precast concrete setting blocks 2 (not shown in FIG. 1; see FIGS. 2-9) that act as the foundation of the bridge, two hollow steel abutment walls 3, four hollow steel wing walls 4 (or flat head walls dependent on the specific design requirements of the customer), a plurality of lower steel beams 5, two steel scour edge beams 6, lower rebar mats 7 (not shown in FIG. 1; see FIG. 5), scour edge beam rebar cages (not shown), a plurality of upper steel tub girders 8, a plurality of upper decking panels 9, upper rebar mats 10, and any means for fastening the various components as needed.

The bridge construction system of the present invention is unique in that it is a steel-frame reinforced composite bridge with decking and rebar caging that provides a permanent, non-removable form for poured-in-place concrete. The composite nature of the bridge allows for installation of the bridge to take place in one day, while the entire process from site preparation such as grading and excavation to cleanup takes a week or less. The quick installation of the bridge is designed to have a minimally invasive impact on the surrounding environment. Further, all steel components that are exposed to earth and water are covered with a finish for corrosion resistance as well and environmental and wildlife concerns. Such a finish may be a zinc flame spray or a zinc primer, among other options.

The bridge construction system of the present invention is intended to provide various design options to customers dependent on their needs. For example, the steel abutment walls are intended to be available in heights of 6 feet, 8 feet, or 10 feet. Further, the bridge construction system is intended to cover roadway widths from 20 feet up to 38 feet in two foot increments. The bridge construction system is also designed to cover a span of a waterway from 15 feet to 40 feet in five foot increments. Also, dependent on the type of bridge and the needs of the customer, various options are available for the traffic way sides of the bridge, from standard curb design, to modified k-rail design, guardrail support, or even an ADA compliant guardrail for pedestrian bridges.

Figure 2:
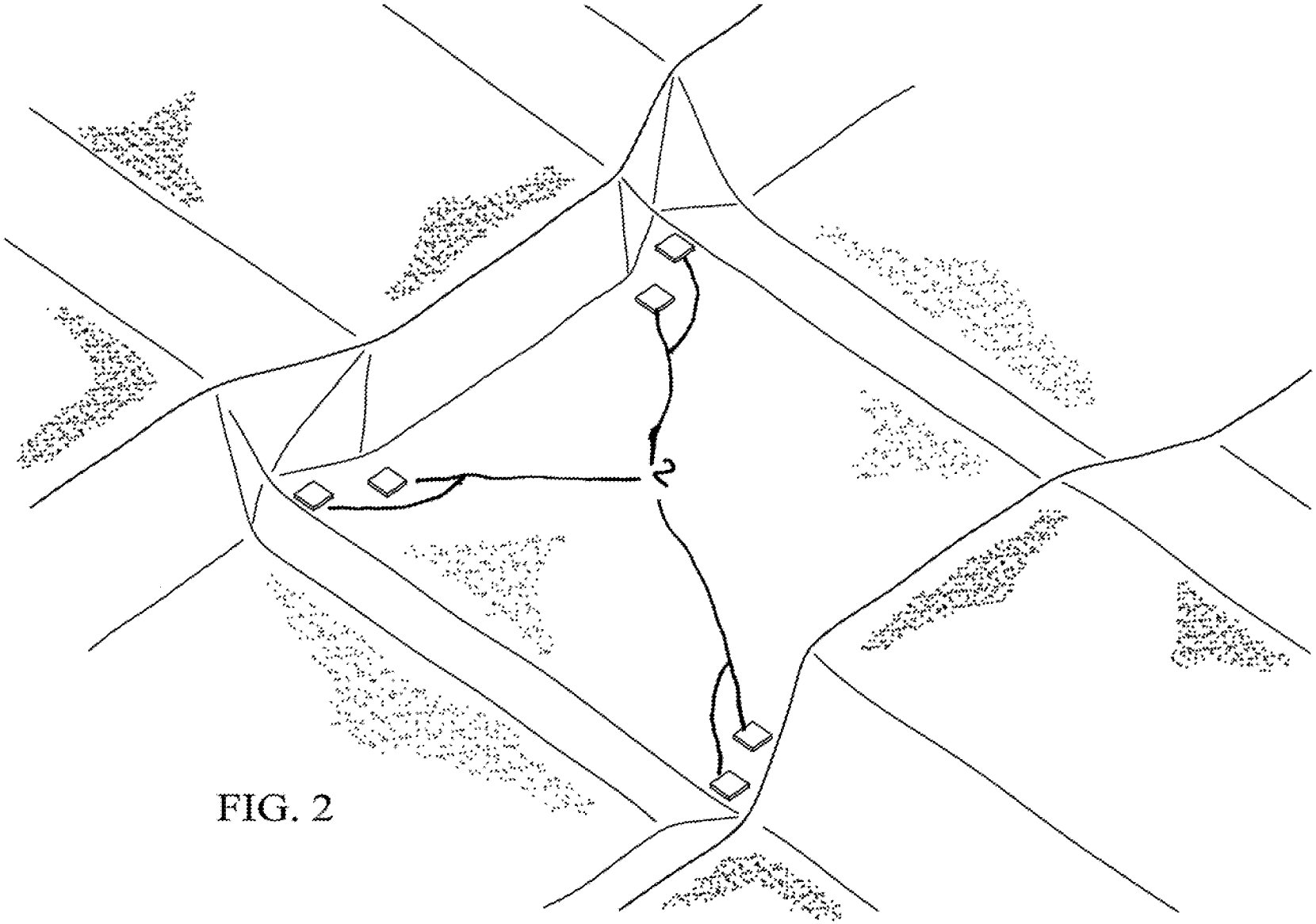
FIG. 2 is an environmental perspective view of the present invention depicting step 2 of the method of the present invention and some components of the bridge construction system of the present invention.
Figure 3:
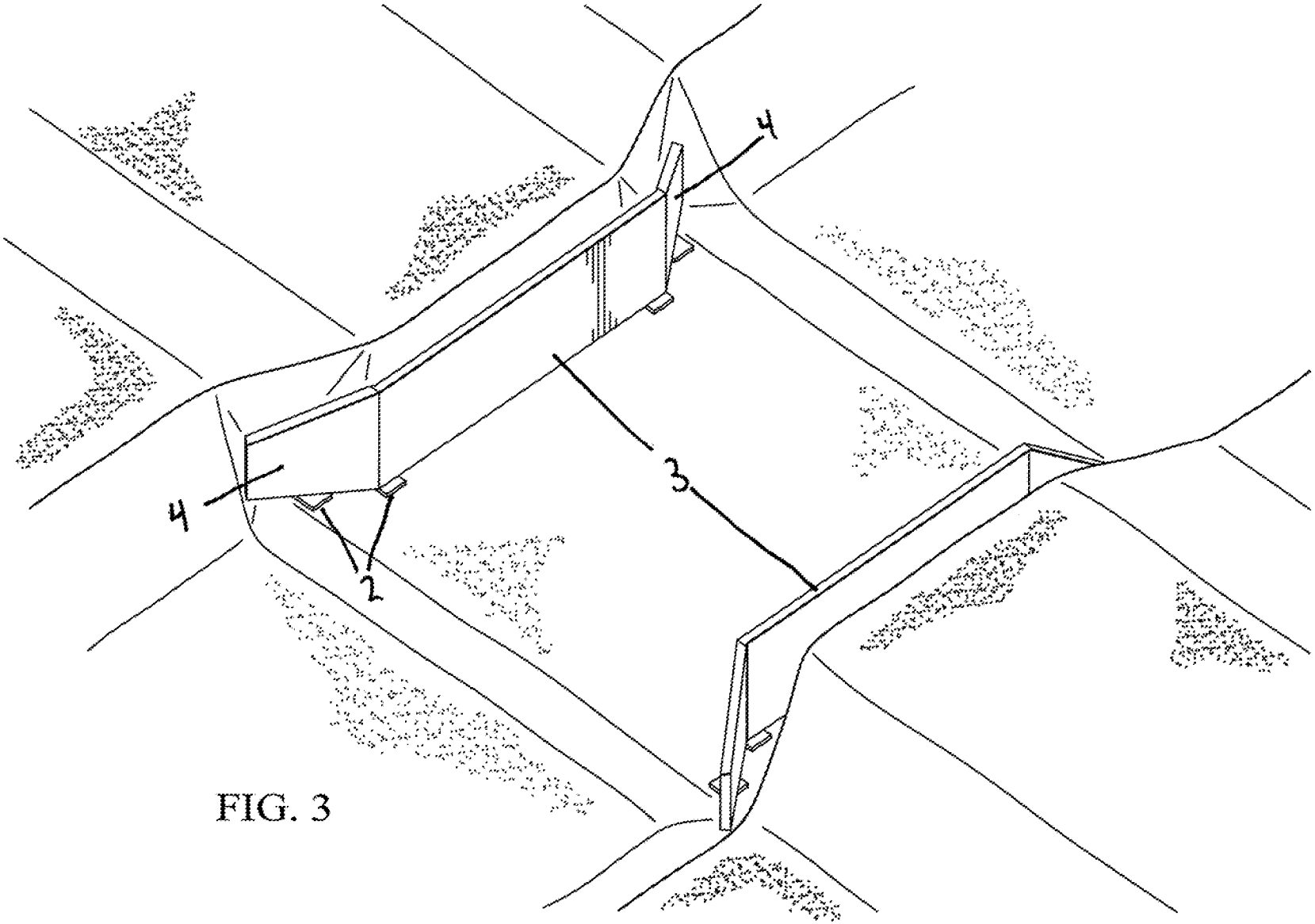
FIG. 3 is an environmental perspective view of the present invention depicting step 3 of the method of the present invention and some components of the bridge construction system of the present invention.

The method for constructing the bridge construction system of the present invention is depicted in FIG. 2 through FIG. 8. The method of construction is comprised of the following steps. The first step is preparing the site where the bridge construction system is to be installed, which comprises demolition of previous infrastructure, if applicable, and excavation and bridge base preparation. Bridge base preparation comprises the site being properly graded and backfilled. The second step is depicted in FIG. 2 and comprises installing the precast concrete setting blocks 2 or "wallpads" according to a specific design's specifications which act as the foundation of the bridge. A minimum of eight precast concrete setting blocks 2 are used. Only six can be seen in FIG. 2 because the other two are covered up due to the angle of the environmental drawing. FIG. 3 depicts the third step which comprises installing the steel abutment walls 3 and steel wing walls 4 or flat head walls (dependent on design) and braces. The abutment walls 3 and corresponding wing walls 4 or flat head walls come to the site already connected together as once single piece/wall. The far abutment and wing wall is set on the precast setting blocks, braced and leveled and then the near abutment and wing wall is set on the precast setting blocks, braced and leveled. The only difference between a wing wall and a flat head wall design is that a wing wall is connected to the abutment wall at an angle, thereby creating a "wing" and a flat head wall is connected along the same line as the abutment wall. In other words, there is no angle or set off between the abutment wall and a flat head wall.

Figure 4:
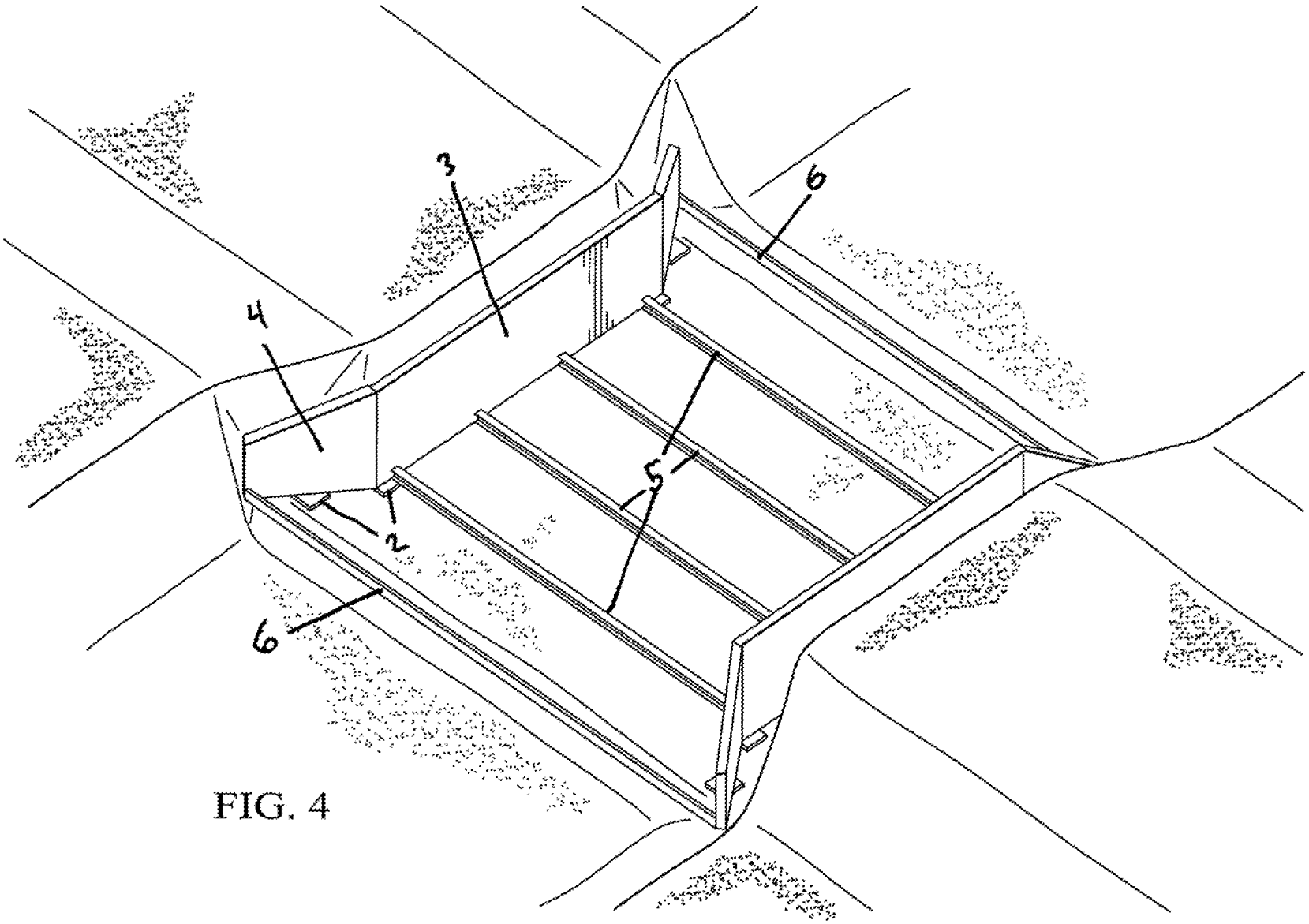
FIG. 4 is an environmental perspective view of the present invention depicting step 4 of the method of the present invention and some components of the bridge construction system of the present invention.

FIG. 4 depicts the fourth step which comprises installing or setting of the plurality of lower steel beams 5 and the two lower steel scour edge beams 6.

Figure 5:
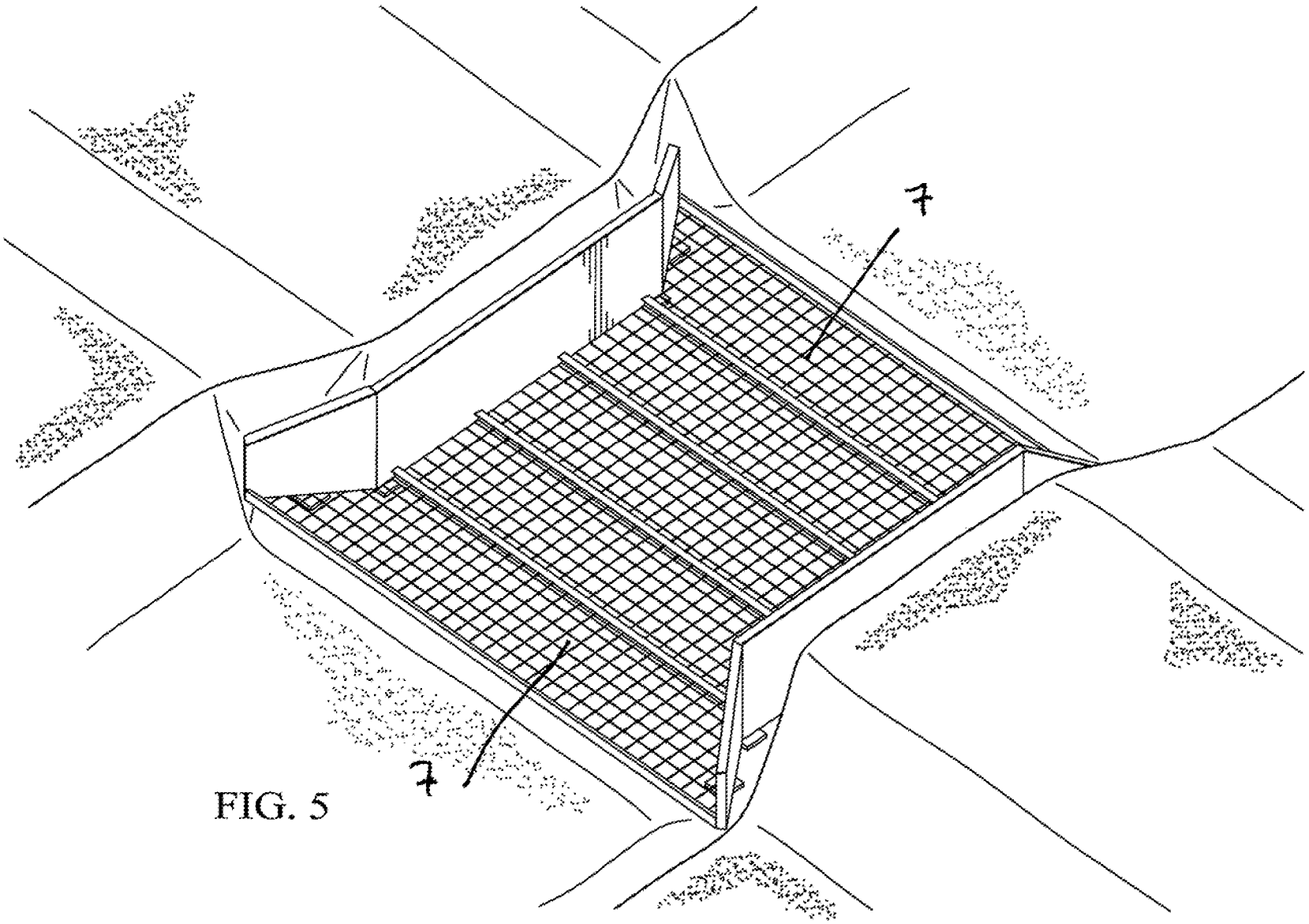
FIG. 5 is an environmental perspective view of the present invention depicting step 5 of the method of the present invention and some components of the bridge construction system of the present invention.

FIG. 5 depicts the fifth step which comprises installing of the lower rebar mats 7 and the scour edge beams rebar cages (not shown).

Figure 6:
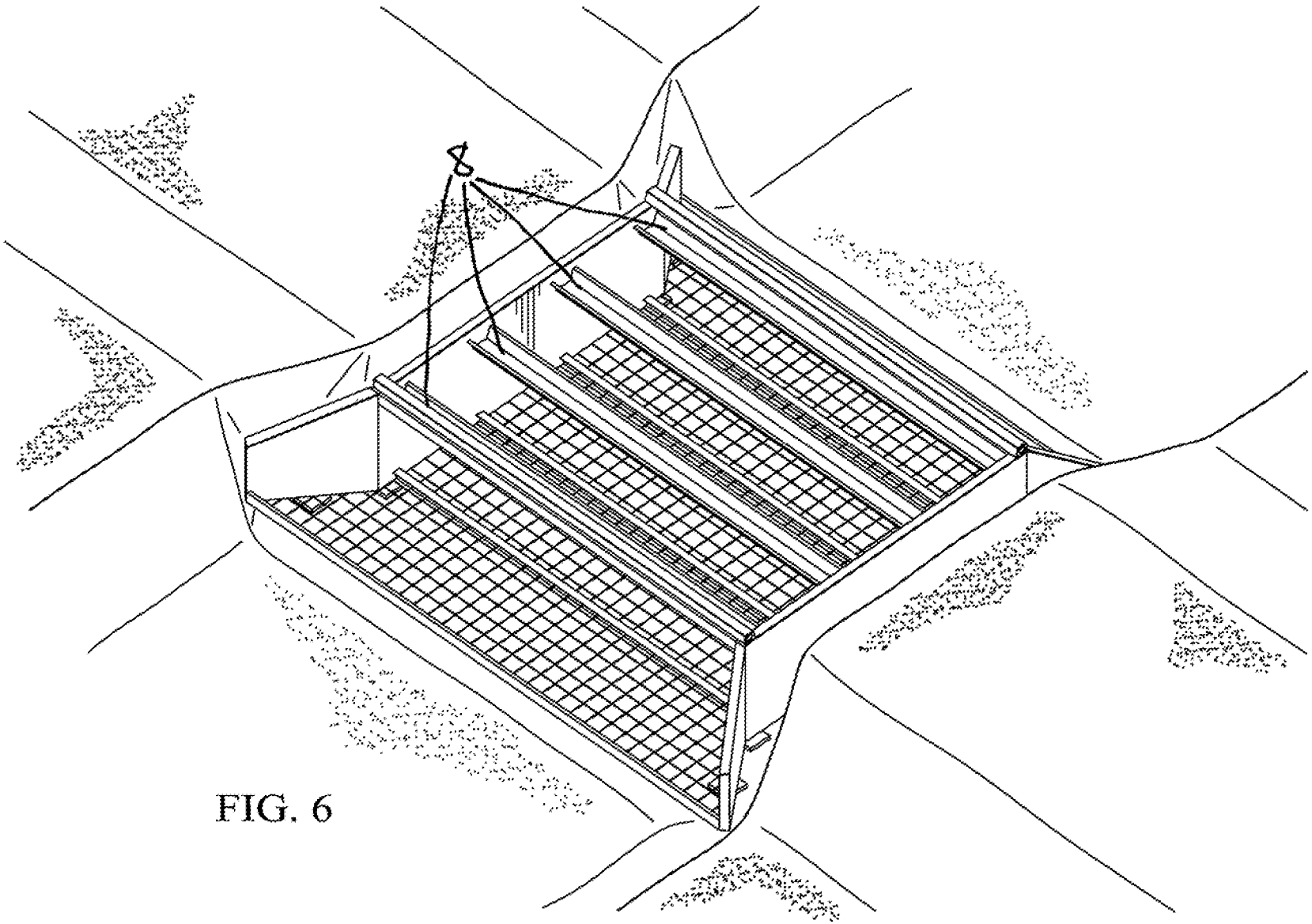
FIG. 6 is an environmental perspective view of the present invention depicting step 6 of the method of the present invention and some components of the bridge construction system of the present invention.

FIG. 6 depicts the method's sixth step which comprises installing the plurality of upper steel tub girders 8.

Figure 7:
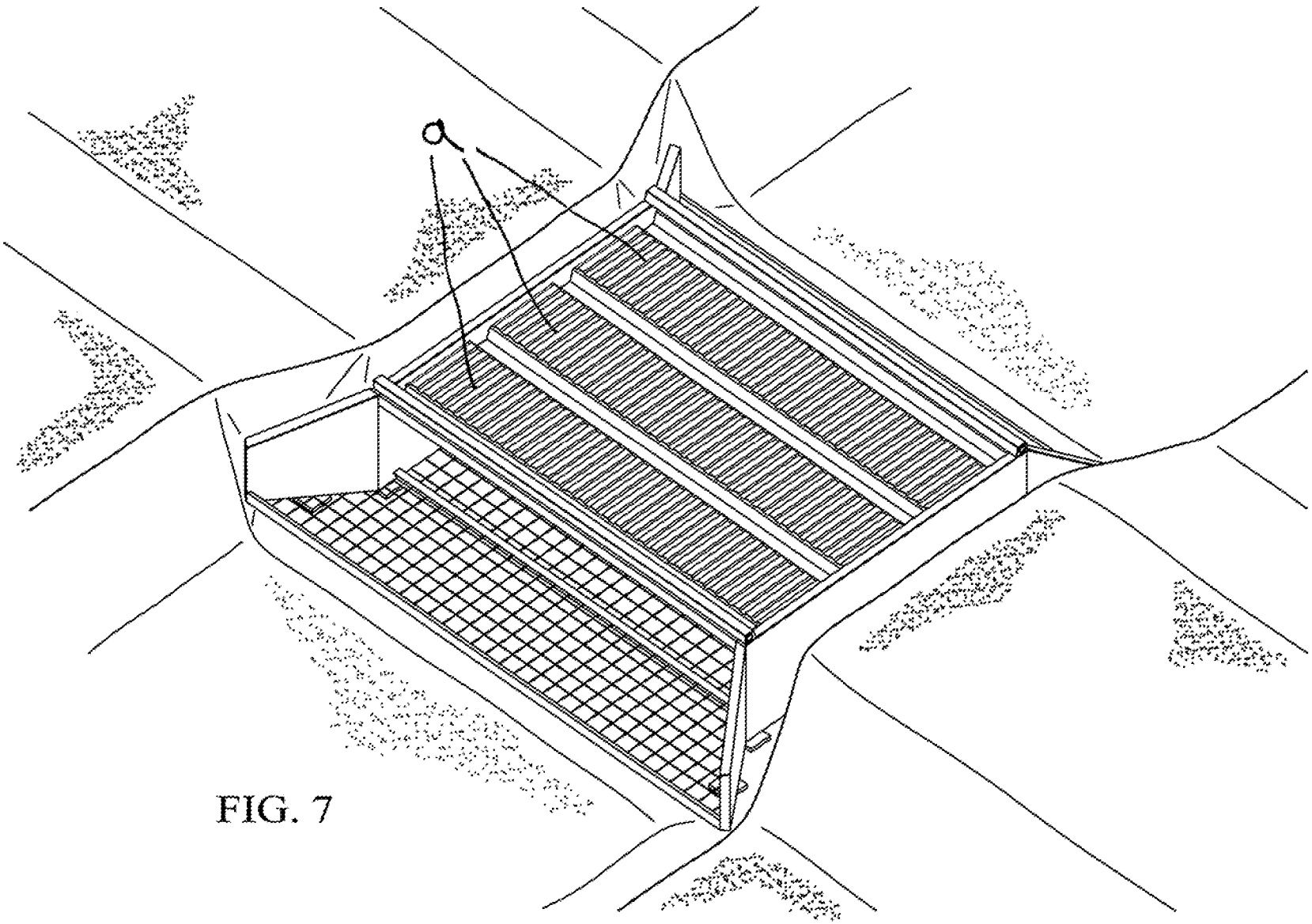
FIG. 7 is an environmental perspective view of the present invention depicting step 7 of the method of the present invention and some components of the bridge construction system of the present invention.

FIG. 7 depicts the seventh step in the method which comprises the installing of the plurality of upper decking panels 9.

Figure 8:
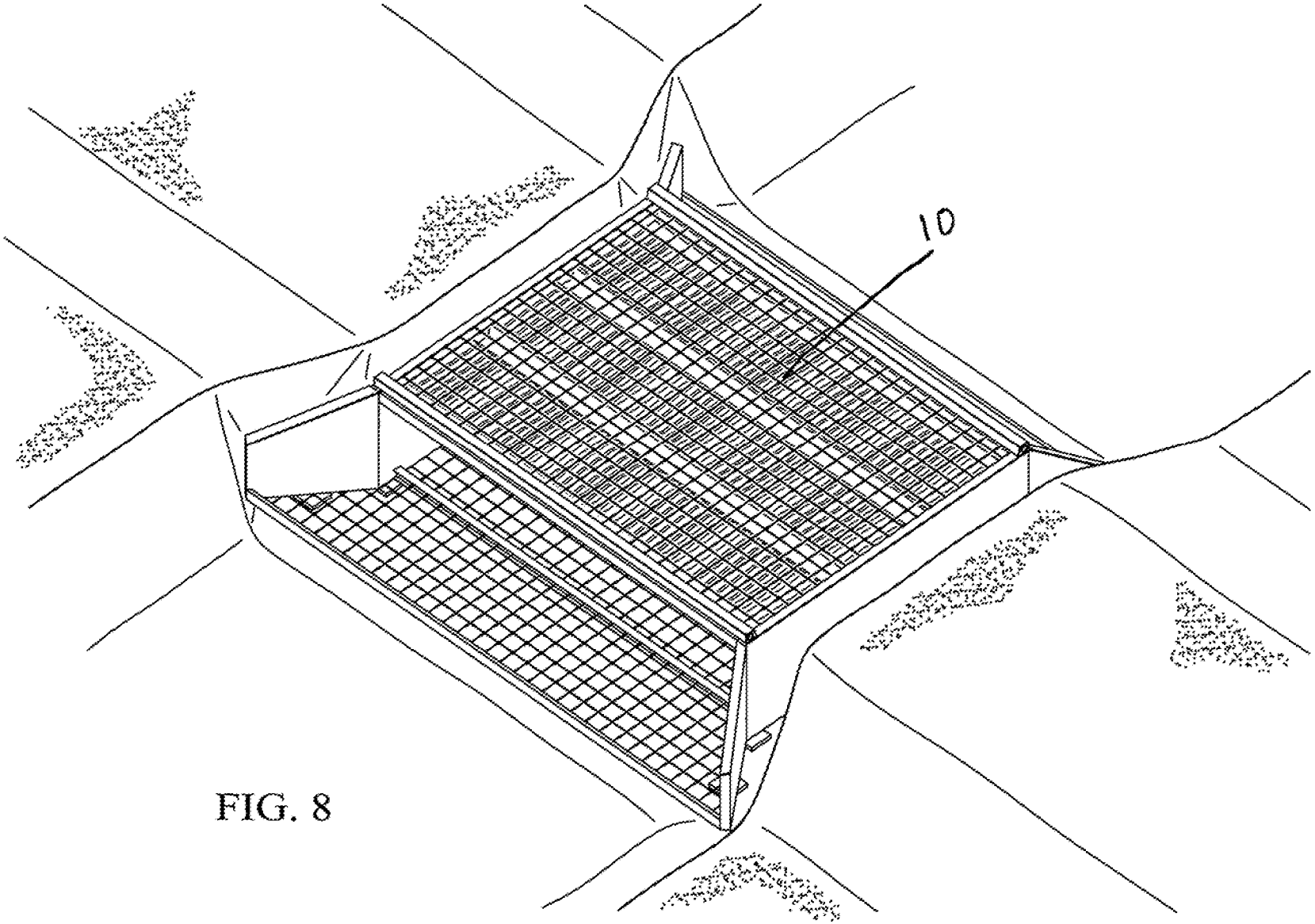
FIG. 8 is an environmental perspective view of the present invention depicting step 8 of the method of the present invention and some components of the bridge construction system of the present invention.

FIG. 8 depicts the eighth step which comprises installing the upper rebar mats 10.

The ninth step comprises the pouring of the concrete where necessary, including the infilling of the composite steel structure of the present invention, specifically the infilling of the abutment walls 3 and corresponding wing walls 4 or flat head walls. Concrete is also poured over the lower rebar mats and the upper rebar mats and decking. The final step comprises site cleanup.

Figure 9:
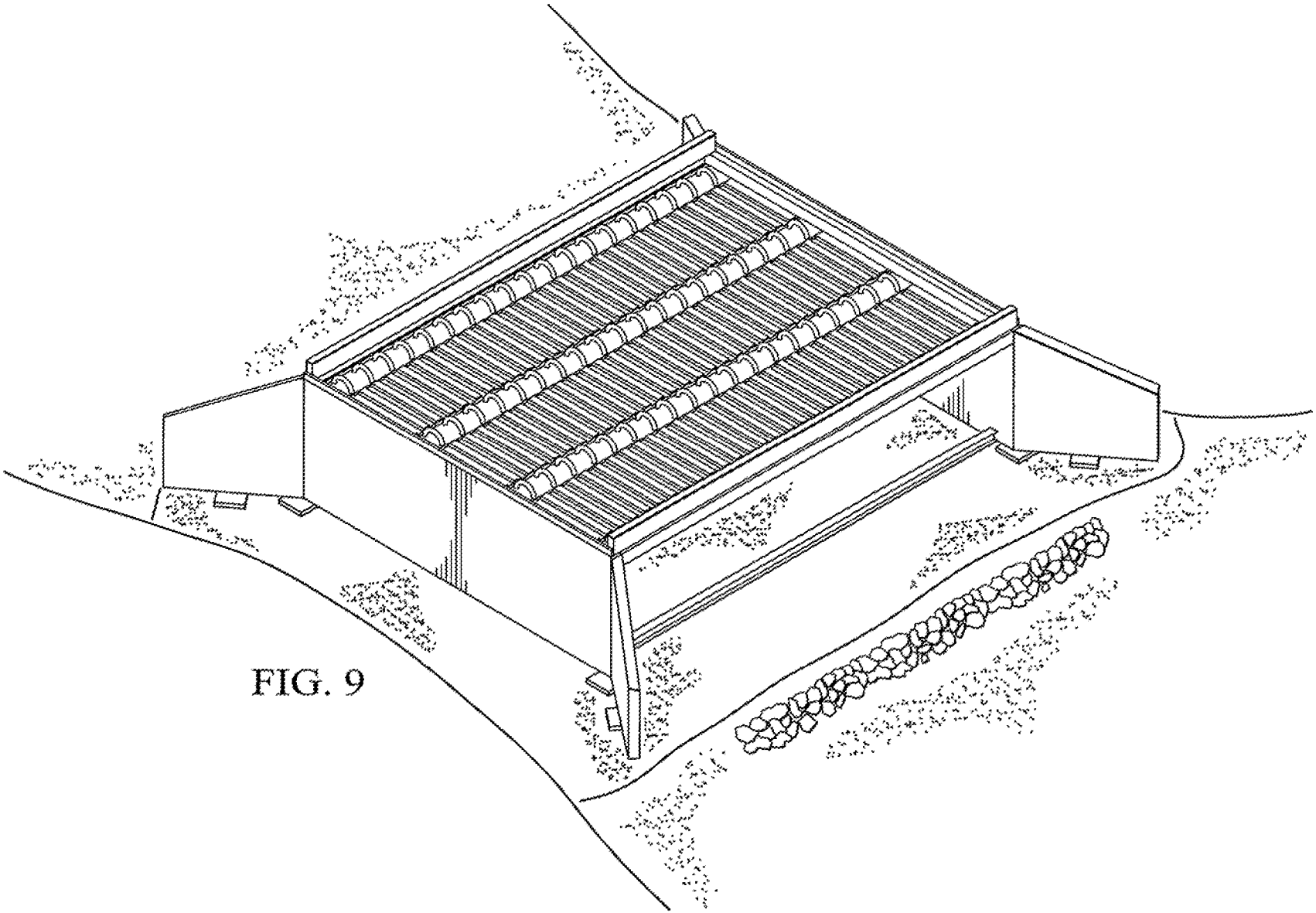
FIG. 9 is an environmental perspective view of the present invention after step 7 depicting another embodiment of the present invention wherein a different tub girder design was used.

FIG. 9 depicts another embodiment of the present invention wherein a different tub girder design was used.

Various changes, alternatives and modifications may become apparent to one of ordinary skill in the art following a reading of the foregoing specification. It is intended that any such changes, alternatives, and modifications within the scope of the appended claims be considered a part of the present invention. Further, it is within the ambit of the present invention to cover any obvious modifications of the preferred embodiment described herein.

What is claimed is:

1. A bridge construction system comprising:

a plurality of abutment walls, wherein said abutment walls are hollow;

a plurality of steel wing walls or head walls, wherein said wing walls or head walls are hollow;

a plurality of lower steel beams;

a plurality of steel scour edge beams;

a plurality of lower rebar mats;

a plurality of scour edge beam rebar cages;

a plurality of upper steel tub girders;

a plurality of upper decking panels; and a plurality of upper rebar mats.

2. The bridge construction system of claim 1, wherein each of the steel abutment walls are each connected together with two of the steel wing walls or head walls so that two or more single walls exist prior to delivery to a jobsite.

3. The bridge construction system of claim 1, wherein the steel abutment walls come in heights of 6 foot, 8 foot, or 10 foot.

4. The bridge construction system of claim 1, wherein said bridge construction system is designed to be capable of spanning a waterway from a width of 15 feet up to 40 feet in increments of 5 feet.

5. The bridge construction system of claim 1, wherein said bridge construction system is designed to be capable of being built to cover roadway widths from 20 feet up to 38 feet in 2 foot increments.

6. The bridge construction method of claim 1, wherein said steel abutment and steel wing walls are covered in a corrosion resistant finish to provide maximum longevity of the steel and to protect against negative environmental and wildlife impacts.

7. The bridge construction method of claim 6, wherein said corrosion resistant finish may be a zinc flame spray or zinc primer.

8. The bridge construction system of claim 1, wherein various edge options are available for the traffic way sides of the bridge, including a standard curb design, a modified k-rail design, guardrail support, or even an ADA compliant guardrail for pedestrian bridges.

9. The bridge construction system of claim 1, wherein said bridge construction system meets American Association of State Highway Transportation Officials loading standards (AASHTO HL-93).

10. A method of constructing a bridge construction system, said method comprising the steps of:

a. preparing a site where the bridge construction system is to be installed, which comprises demolition of previous infrastructure, if applicable, and excavation and bridge base preparation;

b. installing a foundation of the bridge;

c. installing hollow steel abutment walls and hollow steel wing walls or head walls and braces, wherein the steel abutment walls and steel wing walls have already been connected together, where said installing comprises the far abutment and wing wall being set on the foundation, braced and leveled and then the near abutment and wing wall being set on the precast concrete setting blocks, braced and leveled;

d. installing or setting of a plurality of lower steel beams and a plurality of lower steel scour edge beams;

e. installing a plurality of lower rebar mats and a plurality of scour edge beams rebar cages;

f. installing a plurality of upper steel tub girders;

g. installing of a plurality of upper decking panels;

h. installing a plurality of upper rebar mats; and i. pouring of concrete over the lower rebar mats, two scour edge beams rebar cages, the plurality of upper rebar mats, and infilling the hollow portions of the hollow steel abutment walls and hollow steel wing walls.

* * * * *